United States Patent [19]

Palmer et al.

[11] 4,128,486

[45] Dec. 5, 1978

[54] LUBRICANT FOR HIGH TEMPERATURE NUCLEAR SERVICE

[75] Inventors: David N. Palmer, Tolland; John E. Davison, Windsor, both of Conn.

[73] Assignee: Combustion Engineering, Inc., Windsor, Conn.

[21] Appl. No.: 762,915

[22] Filed: Jan. 27, 1977

[51] Int. Cl.[2] ..... C10M 1/10; C10M 3/02; C10M 5/02; C10M 7/02

[52] U.S. Cl. ..... 252/25; 252/49.6; 252/52 R

[58] Field of Search ..... 252/25, 28, 49.6, 52 R

[56] References Cited

U.S. PATENT DOCUMENTS

| | | | |
|---|---|---|---|
| 2,156,803 | 5/1939 | Cooper et al. | 252/25 |
| 2,960,466 | 11/1960 | Saunders | 252/25 |
| 3,196,109 | 7/1965 | Morvay et al. | 252/25 |
| 3,294,682 | 12/1966 | MacKinnon | 252/49.6 |
| 3,384,581 | 5/1968 | Peace | 252/25 |

*Primary Examiner*—Delbert E. Gantz
*Assistant Examiner*—Irving Vaughn
*Attorney, Agent, or Firm*—Fidelman, Wolffe & Waldron

[57] ABSTRACT

Finely divided $B^{11}N$ particles dispersed in a carrier form as anti-gall, anti-seize lubricants in high temperature situations where neutron radiation is present.

Suitable carrier materials comprise volatile solvents, $B^{11}$ carborane polysiloxanes, polyphenyl siloxanes, polyphenyl ethers and dimethyl polyalkylene ether copolymers of methylphenyl siloxanes.

6 Claims, No Drawings

LUBRICANT FOR HIGH TEMPERATURE NUCLEAR SERVICE

DESCRIPTION OF THE INVENTION

This invention relates to anti-seize/anti-gall lubricants for nuclear service at elevated temperatures, in particular to the material applied at metal to metal interfaces to prevent seizure or fusion of one surface of the metal to the other.

Maintenance of nuclear reactors, including notably periodic disassembly operations such as removal of vessel heads can be most difficult because the reactor vessel has been subjected to elevated temperatures and to significant levels of radiation. Vessel head stud closure bolts, for example will seize in the absence of an anti-seize lubricant. Yet, most lubricants known to the art cannot withstand long term exposure to elevated temperature and/or irradiation exposures (either gamma or neutron particles).

$MoS_2$ lubricants suggested for service under elevated temperature conditions have not been found completely satisfactory for nuclear reactor structures operated at above about 500° F. At elevated temperatures and under irradiation conditions molybdenum disulfide undergoes decomposition, releasing potentially corrosive substances.

Graphite lubricants suggested for service in nuclear fields lose some of their unique lubricant properties at elevated temperatures. In addition graphite undergoes interlammelar damage with platen swell in gamma fields resulting in decreased efficiency of the graphite as a lubricant.

On the other hand, boron nitride which has a lammelar structure similar to graphite is less susceptible to interlammelar damage in gamma fields, and loses less of its lubricant properties at elevated temperatures. Boron nitride has been suggested as an anti-seizing lubricant for thread joined metal parts subjected to high temperatures (c.f. U.S. Pat. No. 3,294,682). Unfortunately, boron nitride as used is not resistant to neutron radiation (c.f. U.S. Pat. No. 3,196,109, col. 5 lines 6–9). All natural BN contains a mixture of $B^{10}$ and $B^{11}$ isotopes (18.4 a/o $B^{10}$) and $B^{10}$ is the isotope unsuitable for lubricant purposes in a nuclear reactor. $B^{10}$ is an effective neutron absorber and has been employed as a nuclear poison. $B^{10}$ has a high thermal neutron cross-sectional area ($\sigma$ = 3840 barns). It absorbs neutrons and transmutates to other elements forming long-lived transmutation byproducts which will exist interstitially in the BN lattice and ultimately destroy the lubricating structure of the BN molecule. On the other hand $B^{11}$ has a low thermal neutron cross-sectional area ($\sigma$ = 0.005 barns) and is a poor neutron absorber. $B^{11}$ will not transmutate. $B^{11}N$ remains stable in high irradiation fields.

The present invention contemplates use of $B^{11}N$, as an anti-seizing compound to be applied to threaded metal parts prior to their joining. This compound is particularly effective for elevated temperature nuclear reactor applications. For such usage the $B^{11}N$ is, of course, formulated in a carrier composition so that the solid lubricant can be thinly but evenly placed between the threadedly engaged members. In some cases the carrier composition includes constituents that function as a secondary lubricant or as a lubricant assisting material.

An anti-seize/anti-gallant type lubricant must possess a continuous network of lubricant molecules or molecule agglomerates over the substrate surface in order to function in a satisfactory manner in gallant applicants. The continuous network or film structure must be capable of withstanding very high point stress pressures and relatively high compressive forces without film rupture, but must also yield or slide to impart lubricity. Film adhesion, network coherency, and film strength in unbindered lubricants are controlled by many variables including dispersion homogeniety and surface wetting. Thus the proper addition of film forming aids (surfactants/dispersants) and matrix extenders is most desirable in the development of a useful anti-seize/anti-gallant lubricant.

It should also be noted that a balance must be maintained between dispersants/surfactants additions and vehicle or secondary lubricant additions in order to avoid negation of the purpose of each addition to the lubricant formulation.

First and foremost, the carrier is required to disperse and dilute the $B^{11}N$ so that it may be applied as thinly and evenly as possible over the metal surface. Thus, a volatile solvent vehicle alone may serve for carrier purposes, volatile being arbitrarily taken as 100% evaporation at below 400° F. Exemplary volatile carriers are isopropanol and toluene. Other functions that can be served by the carrier material or materials are as surfactant, extender, additional lubricant, film former, and dispersent aid. Since such functions normally require non-volatile materials, it is significant to point out that any non-volatile carrier substance must meet the nuclear service standards for purity and for stability in a nuclear field at elevated temperatures.

Thus extenders, supplementary lubricants, etc. suitable for practice of this invention should exhibit a high level of stability in the range of 500° F.–700° F. In particular, the materials should exhibit a vapor pressure below $10^1$ atmospheres at 650° F., they should be free of nuclear poisons, and they should decompose into materials that will not create severe corrosion problems for their environment. In total, only a few classes of non-volatile materials, all polymers, have been found that are suitable for non-volatile carrier substances. They are:

(1) $B^{11}$ carborane polysiloxanes
(2) Polyphenyl ethers
(3) Polyphenyl siloxanes/polyalkylaryl-siloxanes
(4) Dimethyl polyalkalene ether copolymers of methyl phenyl poly-siloxanes In the instance of each of the above polymers, the polymer should be a non-reactive fully polymerized substance. Thermosetting under service conditions is not considered desirable for practice of this invention.

Non-reactive side chain groups and end groups should be present, which in the instance of the $B^{11}$ carborane polysiloxanes might be methyl, phenyl or cyano. The low vapor pressure at 650° F. already alluded to constitutes an indication of a fully polymerized polymer. As a whole each of the polymers should be a viscous oil (100–10,000 cps).

Normally, a carrier composition with which the $B^{11}N$ is formulated, including any of the above listed polymers, will include more than one of the polymers, but practice of this invention contemplates using any of the above polymer materials (alone) for carrier purposes. In such instance a volatile solvent often will be employed to facilitate dispersion of the $B^{11}N$ within the carrier. In this connection it is important to appreciate that the above listed polymers often are more than diluents for the $B^{11}N$. They may be film formers and/or lubricants and/or surfactants, with the nature of the composition as a whole and the skill of the formulator determining what ingredients (and their proportions) should be in the carrier.

Examples of film former materials use to aid in the dispersion or binding of the lubricant include the silicone fluids, notably the more heat stable alkyl aryl polysiloxanes such as DC-550 and DC-710 (Dow Chemical Co. of Midland, Michigan). Such polysiloxane film formers also serve as secondary lubricants.

Desirably, small but effective quantities of dispersants, or surfactants e.g. about 0.5% of dimethyl polyalkylene ether copolymers of methylphenylpolysiloxane are employed in the carrier to assist in surface wetout for lubrication efficiency.

A particular class of thickener lubricants contemplated for carrier purposes in the compositions of the present invention are $B^{11}$ -carborane-polysiloxane. Carborane polysiloxanes are a group of materials which are prepared by adding a carborane moiety to a polysiloxane polymer backbone. The carborane monomer herein contemplated has been enriched in $B^{11}$ isotopic concentrations at the expense of the natural $B^{10}$ isotope found in natural boron containing materials. Isotopic enrichment of $B^{11}$ in boron containing monomers may be accomplished by standard isotopic enrichment methods. Several types of carborane polysiloxanes are described in U.S. Pat. Nos. 3,388,091 and 3,388,093. (However, these patent do not relate to $B^{11}$ enriched materials). The carborane polysiloxanes serve as thickeners and lubricants, and for such purposes the polymers should have a viscosity exceeding about 1,000 centipoise.

Since nuclear reactor applications are concerned with trace chemical impurities that may cause corrosion and/or nuclear reaction by products that interfere with lubrication efficiency, all ingredients (including $B^{11}N$ and carrier alike) should be held to substantial purity levels, as follows:

| | |
|---|---|
| Total Fluorine | 100 ppm |
| Total Chlorine | 100 ppm |
| Leachable Cl- | 100 ppm |
| Total Sulfur | 100 ppm |
| Leachable F- | 1 ppm |
| Lead | 50 ppm |
| Mercury | 50 ppm |
| Phosphorous | 50 ppm |
| Total heavy metals | 200 ppm |

The oils and greases, e.g. the polymers, will be white to pale yellow in color having a viscosity range of 100–10,000 cps (100° F. at 20 $sec^{1}$).

The $B^{11}N$ should used is finely divided for good suspension in the carrier and even distribution at the metal interface surfaces. Specifically, the $B^{11}N$ has a particle size of no greater than 1 micron (no less than 65%), remainder no greater than 37 microns (−400 mesh).

After being applied to the surface to be lubricated, the lubricant composition may take the form of an oil, a grease or a film, with the relative proportions of $B^{11}N$ to carrier and the carrier composition largely being determinative of the product form.

The $B^{11}$ carborane polysiloxanes are preferred carrier materials as against the more simple polysiloxanes, e.g. polyphenyl siloxane, and the polyphenyl ethers. Because of their cage structure, carborane poly siloxanes can redistribute thermal energy with greater efficiency than more simple polysiloxanes, and are more stable at elevated temperatures. In neutron environments, the $B^{11}$ carboranes are more stable than more simple polysiloxanes.

As a whole the polyphenyl ethers are least preferred for carrier purposes. Ether siloxane type materials and the carborane polysiloxanes do not degrade to carbon chars under nuclear thermal conditions. Instead such materials degrade to a C-O-Si-O type residue that seems to act more as pseudo-binders than as char abrasives-/adhesives. This type of degradation is more pronounced with the carborane polysiloxanes and the dimethyl polyalkylene ether copolymers of methylphenyl polysiloxanes than with the simpler polysiloxanes.

Overall the $B^{11}N$ will constitute 7.5–30% by weight of the composition with the balance being carrier. However, each of the above carriers, and the desired form of the lubricant composition, have an individual range of proportions. Thus when a $B^{11}$ carborane polysiloxane, the preferred extender-lubricant, is present in the lubricant composition the $B^{11}N$ range is 7.5–25 w/o (wt percent) and the $B^{11}$ carborane polysiloxane is 10–45 w/o.

A multiplicity of formulations are contemplated within the preferred ranges for $B^{11}N/B^{11}$ carborane polysiloxane formulations depending upon the use of the lubricant and the lubricant from desired.

In most formulations 0.25–5 w/o of the dimethyl polyalkylene ether copulymers of methylphenyl polysiloxane is included principally for surfactant purposes.

Solid lubricants of the lammelar or platen type lubricant e.g. BN are difficult to maintain homogeneously dispersed in a carrier. A dispersing aid helps maintain homogeneous dispersion and emulsion stability. In addition, the lubricant solids have some degree of repulsion to metal surfaces. Presence of surfactant in the lubricant formulation will reduce the repulsion of the solid lubricant to the substrate surface by reducing the differential contact energies between the solid lubricant and the substrate surface. The lubricant solids can then form a continuous lubricating network on the substrate surface.

Certainly, a carrier material that functions as both a dispersant and a surfactant would be advantageous. Unfortunately, relatively few materials possess this duality because of the nature of the BN and the nature of the lubricated metal substrates. Dimethyl polyalkylene ether copolymers of methylphenyl polysiloxanes do, however, exhibit dispersant/surfactant properties with BN and carbon steel (substrate) surfaces.

Dimethyl polyalkylene ether copolymers of methylphenyl polysiloxanes surfactants may well be unique for dispersant/surfactant purposes in $B^{11}N$ formulations, because sulfur or halogen containing surfactants can not be employed on many nuclear service components. Moreover, dimethyl polyalkylene ether copolymers of methylphenyl polysiloxanes have only about 25 w/o carbon and do not degrade to a carbon char (a point already made).

TYPE A Nuclear Grade 400°–650° F; 1000–5000 R/hr. 90% gamma, 10% fast neutron, 2–3 Mev energy spectrum; 1–3 years service; $B^{11}N$ and/or polysiloxanes (phenyl-or methyl-phenysiloxanes) and/or $B^{11}$ carborane methylphenyl polysiloxanes and polyphenyl ethers.

#1 Modification (α) - Stable Oil to Grease Emulsion - Multiple Vehicle System

Weight Percent

-continued

| Component | Function | w/o |
|---|---|---|
| (a) $B^{11}N$ (non-turbostratic hexagonal) | solid lubricant | 9.5–23.5 |
| (b) Phenylpolysiloxane A[a] | vehicle extender | 22.5–33.0 |
| (c) Phenylpolysiloxane B[b] | vehicle extender | 22.5–33.0 |
| (d) $B^{11}$-carborane methyl[c] | thickener/ lubricant | 45.0–10.0 |
| (e) GE SF-1066* | wetting agent/ dispersent oil | 0.5–0.5 |

*dimethyl polyalkylene ether copolymer of a methyphenyl polysiloxane. A similar compound SF-1098 is manufactured by General Electric Corporation, Waterford, New York.

#1 Modification (β) - Stable Oil to Grease Emulsion - Multiple Vehicle System

| Component | Function | Weight Percent w/o |
|---|---|---|
| (a) $B^{11}N$ (non-turbostatic hexagonal) | solid lubricant | 9.5–23.5 |
| (b) Polyphenyl ether[d] | vehicle extender | 20.0–30.0 |
| (c) Phenylpolysiloxane B[b] | vehicle extender | 25.0–36.0 |
| (d) $B^{11}$-carborane methyl polysiloxane[c] | thickener/ lubricant | 45.0–10.0 |
| (e) GE SF-1066 | wetting agent/ dispersent oil | 0.5 0.5 |

NOTE:
[a]similar to Dow Corning 550 silicone oil
[b]similar to Dow Corning 710 silicone oil
[c]similar to Analabs (Olin) Dexsil 300 carborane polysiloxane, $B^{11}$ content - 100% $B^{10}$ content less than 10 ppm or Union Carbide USCARSIC of similar composition
[d]6 ring TYPE A #2 Modification (α) - Stable Oil to Grease Emulsion - Simple Vehicle System

| Component | Function | Weight Percent w/o |
|---|---|---|
| (a) $B^{11}N$ (non-turbostratic hexagonal) | solid lubricant | 11.5–25.5 |
| (b) Polyphenyl ether[d] | vehicle/extender | 43.0–64.0 |
| (c) $B^{11}$-carborane methyl polysiloxane | thickener/lubricant | 45.0–10.0 |
| (d) GE SF-1066 | wetting agent/ dispersent aid | 0.5–0.5 |

#2 Modification (β) - Stable Oil to Grease Emulsion - Simple Vehicle System

| Component | Function | Weight Percent w/o |
|---|---|---|
| (a) $B^{11}N$ (non-turbostratic hexagonal) | solid lubricant | 12.5–26.5 |
| (b) Polysiloxane A[a]/or B[b] | vehicle/extender | 42.0–63.0 |
| (c) $B^{11}$-carborane methyl polysiloxane [d] | thickener/ lubricant | 45.0–10.0 |
| (d) GE SF-1066 | wetting agent/ dispersent aid | 0.5–0.5 |

#2 Modification (γ) - Stable Oil to Grease Emulsion - Simple Vehicle System

| Component | Function | Weight Percent |
|---|---|---|
| (a) $B^{11}N$ (non-turbostratic hexagonal) | solid lubricant | 9.5–23.5 w/o |
| (b) $B^{11}$-carboranemethyl-phenylpolysiloxane [e] | vehicle/extender | 45.0–66.0 w/o |
| (c) $B^{11}$ carborane methyl polysiloxane | thickener/lubricant | 45.0–10.0 w/o |
| (d) GE SF-1066 | wetting agent/ dispersent | 0.5–0.5 w/o |

NOTE:
[e]similar to Analabs (Olin) Dexsil 400 $B^{11}$ enriched $B^{11}$ content 100% $B^{10}$ content 100 ppm

#2 Modification (δ) - Stable Oil to Grease Emulsion - Simple Vehicle System

| Component | Function | Weight Percent |
|---|---|---|
| (a) $B^{11}$ (non-turbostratic hexagonal) | solid lubricant | 12.5–26.5 w/o |
| (b) $B^{11}$-carboranemethyl-2-cyanoethylpolysiloxane[f] | vehicle/extender | 42.0–63.0 w/o |
| (c) $B^{11}$-carboranemethyl-polysiloxane | thickener/lubricant | 45.0–10.0 w/o |
| (d) GE SF-1066 | wetting agent/ dispersent aid | 0.5–0.5 w/o |

#2 Modification (ε) - Stable Oil to Grease Emulsion - Simple Vehicle System

Same as Modification (δ) with the following exception:

| | | |
|---|---|---|
| $B^{11}$-carboranemethyl-2-cyanoethylpolysiloxane[f] | vehicle/extender | 22.5–33.0 w/o |
| Polyphenylether [d] | vehicle/extender | 22.5–33.0 w/o |

#2 Modification (ζ) - Stable Oil to Grease Emulsion - Simple Vehicle System

Same as Modification (δ) with the following exception:

| Component | Function | Weight Percent |
|---|---|---|
| $B^{11}$-carboranemethylphenyl-polysiloxane | vehicle/extender lubricant | 22.5–33.0 w/o |
| $B^{11}$-carboranemethyl-2-cyanoethylpolysiloxane | vehicle/extender/ lubricant | 22.5–33.0 w/o |

NOTE:
[f]similar to Analabs (Olin) Dexsil 410; $B^{11}$ content = 100% $B^{10}$ content <100 ppm TYPE C Nuclear grade 400°–650° F; 1000–5000 R/hr. 90% gamma; 10% fast neutron; 2–3 Mev energy spectrum, 1–3 years service; $B^{11}N$ and/or polysiloxanes or $B^{11}$ carborane polysiloxanes and polyphenyl ethers used as castable film binders utilizing a volatile vehicle for casting.

#1 Modification (α) - Castable Lubricant Solid Film

| Component | Function | Weight Percent |
|---|---|---|
| (a) $B^{11}N$ (non-turbostratic hexagonal) | solid lubricant | 9.0–25.0 w/o |
| (b) $B^{11}$-carborane methyl polysiloxane | matrix extender/ lubricant/film former | 1.0–5.0 w/o |
| (c) Toluene | volatile vehicle | 89.5–69.5 w/o |
| (d) SF-1066 | wetting agent/ dispersent aid | 0.5–0.5 w/o |

#1 Modification (β) - Castable Lubricant Solid Film

| | | |
|---|---|---|
| (a) $B^{11}N$ (non-turbostratic hexagonal) | solid lubricant | 9.0–25.0 w/o |
| (b) SF-1066 | wetting agent | 0.5–0.5 w/o |
| (c) ISOPROPANOL | volatile vehicle | 90.5–74.5 w/o |

#2 Modification (ζ) - Castable Lubricant Solid Film

| Component | Function | Weight Percent |
|---|---|---|
| (a) $B^{11}N$ (non-turbostratic hexagonal) | solid lubricant | 13.0–25.0 |
| (b) polyphenylsiloxane[i] | extender/film former | 5.0–7.0 |
| (c) polyphenyl ether[d] | extender/film former | 5.0–7.0 |
| (d) SF-1066 | dispersent agent | 0.02–0.03 |
| (e) Acetone | colatile vehicle | 76.98–60.97 |

NOTE: [i]similar to Analabs OV101

A series of $B^{11}N$ lubricants compounded as listed in the table below were exposed to simulated vessel head stud closure bolt galling/high temperature conditions and evaluated for long term service relative to $MoS_2$ (Super Moly — J. A. Postal Corp.) commercial type lubricants.

TABLE

| System | $B^{11}N$ | DC-550 | DC-710 | $B^{11}$ Carborane-methyl[c] | $B^{11}$ Carborane 2-Cyanomethyl[f] | Polypheny Ether | SF-1006 | Isopropanol |
|---|---|---|---|---|---|---|---|---|
| A-1 α | 18 | 27 | 27 | 27.5 | — | — | 0.5 | — |
| A-1 β | 18 | — | 29 | 27.5 | — | 25 | 0.5 | — |
| A-2 β | 19.5 | 52.5 | — | 27.5 | — | — | 0.5 | — |
| A-2 ε | 19.5 | — | — | 27 | 27 | 26 | 0.5 | — |
| C-1 β | 17 | — | — | — | — | — | 0.5 | 82.5 |

Based on 200-day continuous exposure data at 650° F., the $B^{11}N$ formulations were found to exceed performance characteristics of commercially available $MoS_2$ type lubricants in a seize/gall configuration simulating vessel head conditions. Further testing at 1800° F. also revealed that $B^{11}N$ formulations performed better than graphitic systems, while $MoS_2$ formulations failed. The table lists torque in foot pounds for the removal of a 13 UNC Class 2B bolt (AISI4037 low alloy carbon steel) threaded into a ½ 13UNC Class 2A socket drilled into 9 × 2 × 1½ inches thick carbon steel bar. Readings indicate initial torque required to relieve a pre-test torque of 50 ft. pounds from the bolt at full seat, and the torque (or lack of torque) to completely remove the bolt from its seat after exposure to 650° F. as a function of time similar to testing per Mil-Spec-907D. The initial 50 foot pounds of torque represents a stress of approximately 50,000 psi in the root area of the bolt and simulates a typical vessel head stud closure bolt stress scaled to laboratory conditions.

The results are tabulated below:

TABLE II

ANTI-SEIZE TESTING AT 650° F

| Lubricant System | Test Time, Weeks 1 Torque Relieve | 1 To Remove | 2 Torque Relieve | 2 To Remove | 4 Torque Relieve | 4 To Remove | 8 Torque Relieve | 8 To Remove | 24 Torque Relieve | 24 To Remove |
|---|---|---|---|---|---|---|---|---|---|---|
| A 2 | 44 | 0 | 74 | CNR | 50 | 0 | — | — | 50 | 0 |
| A 1 | 68 | 0 | 58 | 0 | 93 | 0 | — | — | 70 | 0 |
| A 2 | 60 | 0 | 45 | 0 | 50 | CNR* | 45 | 0 | 75 | 0 |
| A 2 | 73 | 0 | 80 | 0 | 83 | 0 | — | — | 58 | 0 |
| C 1 | 65 | CNR* | 85 | CNR* | 69 | CNR* | 54 | 0 | 40 | 0 |
| $MoS_2$ | 50 | 0 | 70 | 0 | 70 | 0 | 62 | 0 | 73 | 0 |
| Control (no lube) | 85** | — | CNR(7110)** | CNR | — | — | — | — | 110** | — |

NOTES:
Torque in ft-lbs.
CNR = could not remove, i.e. 100 ft-lbs.
Initial insertion torque = 50 ft-lbs
*thought to be related to faulty application and/or mismatch on bolt root rectifys itself at later (see later time data)
**excessively high torque, anything = 85 ft-lbs is considered as unacceptable

What is claimed:

1. An anti-gall, anti-seize lubricant composition adapted for high temperature service in the presence of neutron radiation comprising finely divide $B^{11}N$ particles dispersed in a carrier.

2. The composition of claim 1 wherein the lubricant composition includes a $B^{11}$ carborane polysiloxane.

3. The composition of claim 2 wherein the $B^{11}N$ comprises from 7.5–25 w/o by wt. of the composition and the $B^{11}$ carborane polysiloxane comprises 10–45 w/o of the composition.

4. An anti-gall, anti-seize lubricant composition adapted for high temperature service in the presence of neutron radiation comprising finely divide $B^{11}N$ particles dispersed in a carrier selected from the group consisting of volatile solvents, non-reactive $B^{11}$ carbonate polysiloxanes, polyphenyl ethers, non-reactive polyphenyl siloxanes, dimethyl polyalkylene ether copolymers of methylphenyl polysiloxanes and mixtures thereof.

5. The composition of claim 4 wherein the $B^{11}N$ comprises 7.5–30% of the composition.

6. The composition of claim 4 wherein the dimethyl polyalkylene ether copolymers of methylphenyl polysiloxane is at least about 0.25 w/o of the composition.

* * * * *